United States Patent [19]

Stultz

[11] Patent Number: 4,464,910

[45] Date of Patent: Aug. 14, 1984

[54] ICE HARVESTING MACHINE

[75] Inventor: James Stultz, Astatula, Fla.

[73] Assignee: Crosby Commercial Refrigeration Systems, Inc., St. Petersburg, Fla.

[21] Appl. No.: 409,087

[22] Filed: Aug. 18, 1982

[51] Int. Cl.[3] ..... F25C 5/16

[52] U.S. Cl. ..... 62/320; 241/200; 241/DIG. 17

[58] Field of Search ..... 62/320, 347, 348, 352; 241/200, DIG. 17

[56] References Cited

U.S. PATENT DOCUMENTS

| | | | |
|---|---|---|---|
| 2,511,246 | 6/1950 | Chamberlain | 241/200 X |
| 2,791,887 | 5/1957 | Hennig | 62/320 X |
| 2,927,440 | 3/1960 | Kohl | 62/320 X |
| 2,995,017 | 8/1961 | Breeding | 241/DIG. 17 |
| 3,246,481 | 4/1966 | Douglas et al. | 62/320 |
| 3,592,397 | 7/1971 | Mathys | 241/200 X |
| 3,759,061 | 9/1973 | Nilsson et al. | 62/348 X |
| 4,018,391 | 4/1977 | Jacobsen | 241/200 X |
| 4,094,168 | 6/1978 | Hamner et al. | 62/347 |

*Primary Examiner*—William E. Tapolcai
*Attorney, Agent, or Firm*—Walter J. Monacelli

[57] ABSTRACT

The ice harvesting machine described herein comprises one in which ice, formed in vertical cylinders, bars or sheets, is periodically thawed sufficiently to allow the ice to slide downward to a perforated endless belt having upwardly extending ribs or protrusions which strike the lower end of the ice and break it into pieces which are carried away by the endless belt. In a preferred modification, this machine comprises one in which cylinders of ice are formed on the inside and outside of two pipes arranged with an annular space between the two pipes, through which annular space a refrigerant, such as freon, is circulated while water is allowed to run down the outside surface of the outer pipe and also down the inside surface of the inner pipe. These streams of water are chilled by the refrigerant in the annular space until an appropriate thickness of cylinders of ice has been formed on the outside and inside surfaces where the water had been running. Then the refrigerant is drained and replaced by hot fluid for a sufficient period of thawing to allow the cylinders of ice to slide downward from the annular pipe. As the lower end of the ice cylinders slide below the lower ends of the annular pipe arrangement, they encounter an endless belt which has spaced, upwardly extending ribs which strike the ice cylinders thereby breaking off the lower portions into pieces which are carried off by the endless belt to a chute where they are collected. The endless belt is perforated so that water running down the pipe walls may pass through into a reservoir from where it is recycled to pass over the pipe surfaces for further chilling with refrigerant.

4 Claims, 8 Drawing Figures

ICE HARVESTING MACHINE

BACKGROUND OF THE INVENTION

1. Field of the Invention

This invention relates to an ice harvesting machine which produces vertical cylinders, rods or sheets of ice. More specifically, it relates to such a machine having an arrangement at the lower end thereof whereby the ice formed and lowered in this machine is broken off into pieces which are carried off by an endless belt. Still more specifically, it relates to spaced, raised rib portions of said endless belt which strike against the lowered ice whereby breaking of the lower ends of the ice is effected.

2. Description of the Prior Art

Ice harvesting machines are known for producing tubes or cylinders of ice and detaching the ice cylinders from the pipes on which they are formed so that the cylinders will slide downward. However, the methods of breaking and removing the ice are awkward and inefficient. A variety of systems are illustrated in U.S. Pat. Nos. 2,598,429; 2,870,612 and 3,759,061.

U.S. Pat. No. 2,598,429 discloses apparatus for forming a plurality of elongated rods of ice which are released downward to a stop bar where a cutter converts the rods to short lengths which are dropped onto a tilted mesh screen from which they are directed into baskets, etc.

U.S. Pat. No. 2,870,612 shows apparatus for forming a number of individual cylinders of ice which are lowered to strike bars which rotate about a horizontal axis so as to strike the lower end of the cylinders of ice and thereby break them into small pieces which fall into a chute that directs them into a container.

U.S. Pat. No. 3,759,061 describes apparatus for forming a number of tubes of ice which are released and allowed to slide downward toward a rotating knife which cuts the tubes into small pieces that are dropped down onto a rotating disc on which centrifugal force delivers the ice to a chute.

These and other methods of cutting and breaking ice rely on rotating knives, cutters, screw conveyors and rotating wheels with teeth. These are complicated mechanisms and it would be preferable to have a simple, efficient method for performing this function.

SUMMARY OF THE INVENTION

In accordance with the present invention, an ice harvesting machine has been designed in which the cylinders, rods or sheets of ice sliding down from the ice-forming surfaces are simply and efficiently broken and the resulting pieces carried away. The device for breaking and carrying away the pieces of ice comprises a perforated endless belt having ribs extending across a substantial portion of the width of the belt and also extending upward so as to strike the ice cylinders as the belt passes under the lower ends of the ice. The ribs or upward protrusions are advantageously made of a hard plastic material of sufficient strength to withstand the impact against the ice. The belt itself is advantageously made of links of the same or similar plastic material with open spaces in and between links through which water may pass below to a reservoir for recycling. The belt may also be made of other strong materials including stainless steel and upward protrusions other than a continuous bar may be used.

In a preferred modification of this invention the ice is formed in cylinders by a system in which two pipes of different diameters are arranged concentrically and vertically so that there is an annular space between the two pipes. The ends of the pipes are sealed with an inlet for refrigerant at one end of the annular space and an outlet for refrigerant at the opposite end of the annular space. Water inlets are provided at upper ends of the pipe so that water flows down the outer surface of the outer pipe and also down the inside surface of the inner pipe. The refrigerant is circulated through the annular space so that the water contacting areas are chilled to freeze the water on the water contacting surfaces. These surfaces are advantageously Teflon coated to reduce friction. (Teflon is a registered trademark for product marketed by the DuPont Company.) Such concentric pipe arrangements may be grouped in numbers of two, three, four or more with appropriate width of the endless belt and length of striking bar to accommodate the number of ice cylinders lowered thereon.

The ice harvesting machine of this invention is particularly adapted for use on boats, particularly on fishing boats, to produce ice from sea water for the icing and preservation of fish catches.

Description of the ice harvesting machine of this invention is facilitated by reference to the accompanying drawings in which.

Figure 1:
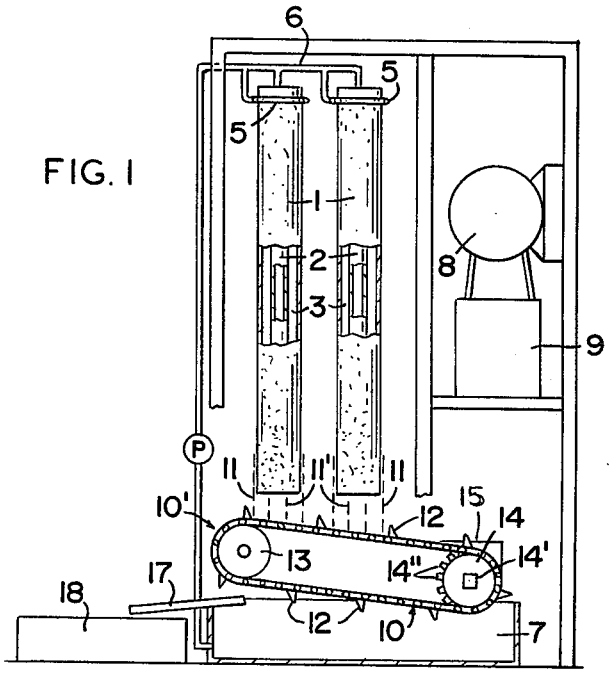
FIG. 1 is a schematic view of the overall equipment for a preferred modification of this invention.

In the general arrangement shown in FIG. 1, two sets of outer pipe 1 and inner pipe 2 have annular space 3 through which refrigerant is passed to chill and freeze water flowing down the outer wall of pipe 1 and down the inner surface of pipe 2. The refrigerant is fed by a tube extending from the top to the bottom of the annular surface so that the refrigerant enters into the bottom of the annular space and exits at the top. Water is fed to the outside of pipe 1 by annular ring 5 through line 6 which is supplied by pump P from reservoir 7 which collects chilled water falling off pipes 1 and 2. Similar means for supplying water to pipe 2 is used but is not shown. Additional water is supplied to reservoir 7 by a waterline (not shown) to replace the water removed as ice. Pipes 1 and 2 are supported only from the top so there will be no interference with the ice cylinders sliding off the respective pipes. Motor 8 drives compressor 9 which compresses freon or similar refrigerant material. The warm, compressed freon gas is cooled in a heat exchanger (not shown) and then released into annular space 3 where the expansion effects the freezing tempertures transmitted through pipes 1 and 2 to form the desired cylinders of ice. A timer is set to allow sufficient time for the desired thickness of ice to be achieved at which time a valve is actuated to divert the warm compressed gas from the heat exchanger and to direct it instead into the annular space 3 until there has been enough thawing of the ice in contact with the surfaces of pipes 1 and 2 that the cylinders of ice slide downward and strike the moving endless belt 10. The bottom of the ice cylinders 11 and 11' are struck and broken by protruding bars 12 of the endless belt 10. The endless belt passes over wheel 13 and is driven by toothed gear wheel or drum 14. The gear wheel or drum 14 has rows of teeth which engage the perforations or openings in the endless belt links. Since these openings are staggered from one link to the next, each row of gear teeth 14'' has the teeth staggered from adjacent rows so as to accommodate the staggered openings. The toothed gear is fitted onto a square shaft 14' which is welded as an extension onto the shaft of motor 15 which is partially hidden behind gear wheel 14. The broken ice falls off the end 10' of the endless belt onto chute 17 which delivers the ice to container 18. When the ice has been removed from the ice forming surface, the ice forming cycle is repeated.

Figure 2:
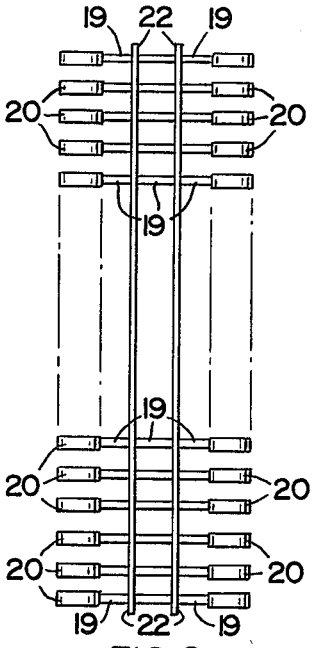
FIG. 2 is a top plan view of a preferred modification of the links used in an endless belt arrangement of this invention.
Figure 3:
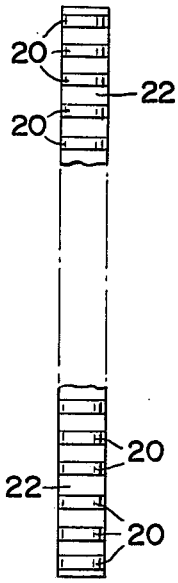
FIG. 3 is a front elevational view of the link of FIG. 2.
Figure 4:
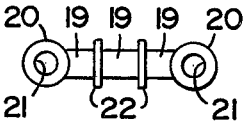
FIG. 4 is an end elevational view of the link of FIG. 2.
Figure 5:
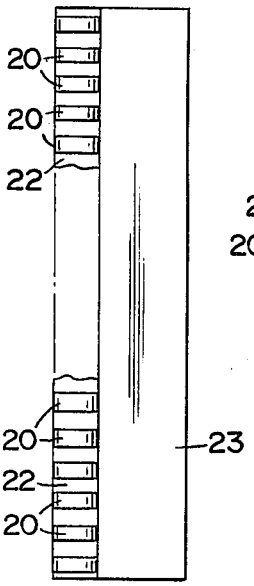
FIG. 5 is a front elevational view of a modified link carrying the impact bar for breaking the ice cylinders.
Figure 6:
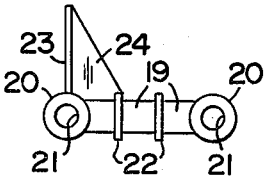
FIG. 6 is an end elevational view of the modified link of FIG. 5.
Figure 7:
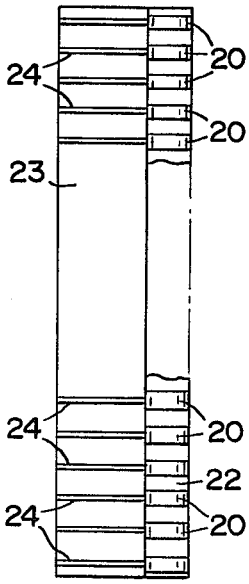
FIG. 7 is a back elevational view of the modified link of FIG. 5.
Figure 8:
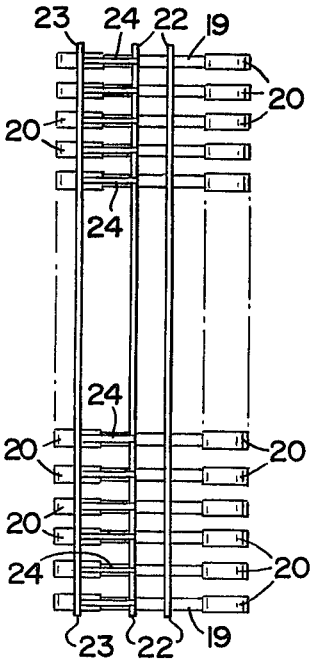
FIG. 8 is a top plan view of the modified link of FIG. 5.

FIGS. 2, 3 and 4 show the construction of a preferred modification of links for a perforated endless belt suitable for use in the practice of this invention. A number of crossbars 19 have rounded ends 20 which have opening 21 in the center thereof. Space bars 22 are welded or integrally formed with the crossbars to hold them in position. There are numerous openings between the crossbars and space bars. The rounded ends at one side of a link are inserted between the respective rounded ends of another adjacent link. When the openings of one link are registered with openings of the adjacent link, a rod of appropriate size (not shown) is fitted through the openings and welded or fastened at one end so as to be irremovable from this position. The joined links are rotatable on this fixed rod.

FIGS. 5, 6, 7 and 8 detail a link similar to that of FIGS. 2, 3 and 4 except that a rigid bar 23 protrudes upward from rounded ends 20. The back of this bar 23 is reinforced by fins 24 which reach from the top of bar 23 to the top of the next space bar 22.

The preferred modification of this invention is the above-described concentric pipe arrangement in which the refrigerant is passed through the annular space between the two concentric pipes. It is also contemplated that the endless belt arrangement may be used in systems where one or more individual vertical pipes may be used. For example, a vertical pipe may have a refrigerant circulated on the inside and ice formed on the outside, or it may have refrigerant circulated on the outside and a cylinder or rod of ice formed on the inside. Moreover, sheets of ice may be formed by having water run down a flat outside surface of a container in which refrigerant is circulated.

The distance of the belt below the ice forming surface is not critical so long as there is sufficient space for the impact bars to clear the pipes. Advantageously, the distance is no greater than 10 inches and preferably about 2–4 inches below the pipes or other ice forming surface. The endless belt may be operated horizontally, but it is preferable to have it tilt slightly upward (for example, about 6°) to avoid having the fallen water carried toward the chute. The slight upward tilting in the direction of the chute counteracts this tendency.

While certain features of this invention have been described in detail with respect to various embodiments thereof, it will of course be apparent that other modifications can be made within the spirit and scope of this invention and it is not intended to limit the invention to the exact details shown except insofar as they are defined in the following claims.

1. In an ice harvest machine operating on a system of feeding a refrigerant into the annular space between two vertically arranged concentric pipes adapted to having water flow down the outside surface of the outer pipe and also down the inside surface of the inner pipe until a sufficient thickness of ice has been formed and then replacing the refrigerant with a warm fluid until sufficient thawing of the ice has been achieved to permit the ice to slide downward, the improvement comprising:

(a) a perforated endless belt positioned below the ice forming system in such a manner that the lower end of ice will strike the belt, the perforations of said endless belt being of sufficient size to allow the free passage of water therethrough; and (b) a series of rigid protrusions spaced on said endless belt, reaching a substantial distance upward and substantially across the width of said endless belt, and adapted upon movement of said belt to strike the lower end of said ice in such a manner as to break the ice, which said endless belt comprises a series of links, each link having perforations therein and having a rigid bar extending upward and reaching substantially across the width of said link, each link having protrusions spaced on the two opposite sides parallel to said bar and arranged so that the protrusions of one link dovetail with the protrusions of an adjacent link, each protrusion on one said side having an opening therein registered with each other and with dovetailed protrusions of an adjacent link and adapted to receive a long cylindrical rod through the registered openings in said dovetailed protrusions so as to provide a flexible connection between said links, each of the series of links being so connected to the two adjacent links to form the endless belt.

2. The ice harvest machine of claim 1 in which there is a drum positioned inside said endless belt, said drum having a number of rows of teeth extending outwardly from the cylindrical surface thereof and each tooth in a row appropriately spaced from adjacent teeth in that row to fit into a row of perforations or openings in said endless belt, and the adjacent rows of teeth having an appropriate space therebetween so that teeth in adjacent rows will fit in perforations of adjacent links with the positioning of teeth in one row being staggered with each adjacent row of teeth so as to fit staggered openings in adjacent links, the length and size of said teeth being appropriate to enter easily and to leave easily the said openings in said links.

3. The ice harvest machine of claim 2 in which the main portion of said endless belt is tilted upward toward the discharge end thereof at a slight angle whereby the tendency of water to be carried thereon is overcome.

4. The ice harvest machine of claim 3 in which said angle is about 6°.

* * * * *

UNITED STATES PATENT AND TRADEMARK OFFICE

CERTIFICATE OF CORRECTION

PATENT NO. : 4,464,910

DATED : Aug. 14, 1984

INVENTOR(S) : James Stultz

It is certified that error appears in the above-identified patent and that said Letters Patent is hereby corrected as shown below:

Col. 4, line 8, insert "THE INVENTION CLAIMED IS".

Signed and Sealed this

*First* Day of *January 1985*

[SEAL]

*Attest:*

GERALD J. MOSSINGHOFF

*Attesting Officer*

*Commissioner of Patents and Trademarks*